US010292516B1

(12) United States Patent
Lopez Rodriguez

(10) Patent No.: US 10,292,516 B1
(45) Date of Patent: May 21, 2019

(54) HAT HANGER

(71) Applicant: Humberto S. Lopez Rodriguez, Renton, WA (US)

(72) Inventor: Humberto S. Lopez Rodriguez, Renton, WA (US)

( * ) Notice: Subject to any disclaimer, the term of this patent is extended or adjusted under 35 U.S.C. 154(b) by 0 days.

(21) Appl. No.: 16/119,660

(22) Filed: Aug. 31, 2018

Related U.S. Application Data

(63) Continuation-in-part of application No. 15/895,902, filed on Feb. 13, 2018, now Pat. No. 10,092,121.

(60) Provisional application No. 62/600,094, filed on Feb. 14, 2017.

(51) Int. Cl.
*A47G 25/10* (2006.01)
*A47F 7/06* (2006.01)

(52) U.S. Cl.
CPC ..... *A47G 25/10* (2013.01); *A47F 7/06* (2013.01)

(58) Field of Classification Search
CPC .... A47G 25/10; A47G 25/32; A47G 25/1457; A47G 25/06; A47G 25/0607; A47G 25/28; A47G 25/30; A47F 7/06; A47F 5/0884; A47F 5/0006; A47F 5/0807; A47F 5/08; A47B 61/003; A47B 61/04; Y10S 224/927; Y10S 223/04; B60R 7/10
USPC ..... 248/304, 339, 301, 309.1, 205.1, 224.8, 248/223.41, 87.01, 85.3, 231.91, 303, 248/216.1, 217.1, 217.3; 211/30–32, 113, 211/87.01, 85.3; 223/85
See application file for complete search history.

(56) References Cited

U.S. PATENT DOCUMENTS

| | | | | | |
|---|---|---|---|---|---|
| 684,312 | A | * | 10/1901 | Rush | F16B 15/04 211/87.01 |
| 1,611,582 | A | * | 12/1926 | Davis | A47G 25/06 211/85.3 |
| 1,703,872 | A | * | 3/1929 | Engelson | A47G 25/06 211/85.3 |
| 1,706,887 | A | * | 3/1929 | Knostman | A47B 61/02 211/85.3 |
| 2,060,711 | A | | 11/1936 | Wright | |
| 2,640,594 | A | | 6/1953 | Lesikar | |
| 3,178,030 | A | | 4/1965 | Huebel | |
| 3,471,031 | A | * | 10/1969 | Coplan | D06F 57/00 211/100 |
| 3,677,415 | A | * | 7/1972 | Radek | A47F 5/0807 248/220.42 |

(Continued)

OTHER PUBLICATIONS

Set of 4 Triangle Hooks in African Mahogany with Teak Oil Matte Finish. Modern Isosceles Wall Hooks. Coat, Towel, Robe Hook. Backpack, Bags. Etsy.com, Accessed: Jan. 31, 2018. https://www.etsy.com/listing/548831334/set-of-4-triangle-hooks-in-african.

*Primary Examiner* — Hiwot E Tefera
(74) *Attorney, Agent, or Firm* — DWC Law Firm, P.S.; James Namiki; David Chen

(57) ABSTRACT

A hat hanger with a small form factor is described herein. The hat hanger having a body with a wall mating face configured to mate with a surface of a vertical wall, and a top side face disposed on a top side of the body and being a serrated face with a plurality of saw tooth members. The wall mating face may include a wall mounting component such as a nail for affixing the hat hanger to the vertical wall. The plurality of saw tooth members may include at least one saw tooth member with a greater height than the other saw tooth members of the plurality of saw tooth members.

19 Claims, 15 Drawing Sheets

(56) References Cited

U.S. PATENT DOCUMENTS

| | | | | | |
|---|---|---|---|---|---|
| 3,746,294 | A * | 7/1973 | Johnston | F21V 21/108 | 211/107 |
| 3,874,035 | A * | 4/1975 | Schuplin | F16B 2/02 | 248/228.2 |
| 4,128,196 | A * | 12/1978 | Hill | A47G 25/1457 | 224/264 |
| 4,863,081 | A * | 9/1989 | Gabbert | B60R 7/10 | 224/550 |
| D323,284 | S * | 1/1992 | Thompson | D6/320 | |
| 5,104,083 | A * | 4/1992 | Shannon | B60R 7/10 | 211/105.1 |
| 5,450,967 | A * | 9/1995 | Mallory | A47F 7/06 | 211/30 |
| 5,762,206 | A * | 6/1998 | Leichter | A47F 7/06 | 211/113 |
| 6,293,413 | B1 | 9/2001 | Patton | | |
| 6,651,945 | B2 | 11/2003 | Rivellino | | |
| 6,698,546 | B1 * | 3/2004 | Sandor, Sr. | E06C 1/34 | 182/107 |
| 8,317,445 | B2 | 11/2012 | Reeder | | |
| 8,807,501 | B2 * | 8/2014 | Chung | B25H 3/04 | 211/70.8 |
| D801,155 | S | 10/2017 | Kuniyoshi | | |
| 2007/0029355 | A1 * | 2/2007 | Dente, Jr. | A47B 61/003 | 223/85 |
| 2007/0205346 | A1 * | 9/2007 | Jackson | A47G 25/0614 | 248/307 |
| 2015/0108304 | A1 | 4/2015 | Larsen Roldan | | |

* cited by examiner

300

400

900

HAT HANGER

CROSS REFERENCE TO RELATED APPLICATION(S)

This application is a continuation-in-part of U.S. patent application Ser. No. 15/895,902, filed on Feb. 13, 2018, which claims the benefit of U.S. Provisional Patent Application No. 62/600,094, filed on Feb. 14, 2017, both of which are incorporated herein by reference in their entireties.

BACKGROUND

1. Field of the Invention

The present invention relates to wall mountable devices, and more particularly, to a hat hanger mountable on a vertical wall.

2. Description of Related Art

In recent years, hats have become a popular form of clothing accessory. Hats come in a variety of forms, shapes, and sizes for a variety of occasions and uses. In some cases, people will wear hats as a fashion statement. In other cases, people will wear particular types of hats for their functionalities in protecting the wearer's eyes, face, and/or neck from excessive sunline or rain. In still other cases, people will wear hats, often in the form of baseball caps, that are adorn with their favorite logos (e.g., the NIKE swoosh) or favorite sporting teams. For at least a small but enthusiastic segment of the population, the collection of hats has become an obsession.

In fact, some hat wearers can be very finicky, if not fanatical, in the care and storage of their hats. For these hat wearers, the big concern is maintaining the proper shapes of their hats. Stored improperly, hats can deform over time from their original or proper shapes.

SUMMARY

Various embodiments of the present disclosure provide for a hat hanger. For these embodiments, the hat hanger may include a body having a height, a length, and a thickness, with a first side face and a second side face disposed opposite of the first side face, wherein the second side face is spaced apart from the first side face by the thickness. The body may also include a wall mating face situated transversely relative to the first side face and the second side face, with a first edge of the wall mating face being adjoined to the first side face, and with a second edge of the wall mating face being adjoined to the second side face.

In various embodiments, a top side face may be situated transversely relative to the first side face and second side face, and being adjoined to the first side face and second side face. A plurality of serrations may be disposed on the top side face, wherein one of the serrations is greatest in height relative to the other serrations of the plurality of serrations. The one of the serrations that is greatest in height is disposed furthest, among the plurality of serrations, from an edge of the top side face that adjoins to the wall mating face.

In various embodiments, a wall mounting device is disclosed that includes a body. A first face may be disposed on the body and having a wall mounting component configured to affix the body to a vertical wall. A second face may be disposed on the body and that adjoins the first face and that has a plurality of saw tooth members, wherein at least one of the saw tooth members is greater in height than other saw tooth members of the plurality of saw tooth members.

In some embodiments, the second face may be an elongated face with a first edge and a second edge opposite from the first edge, and the plurality of saw tooth members are arranged lengthwise along the elongated second face between the first edge and the second edge, the first edge adjoining the first face. For the embodiments, the saw tooth member with the greater height is located nearest to the second edge among the plurality of saw tooth members.

In various embodiments, a wall mounting device is disclosed that includes a first face that may be disposed on a body and configured to affix the body to a vertical wall. A second face that may be disposed on the body and adjoined to the first face, the second face having a plurality of saw tooth members, wherein one of the saw tooth members is greater in height than all other saw tooth members of the plurality of saw tooth members. The second face may be an elongated face that longitudinally extends away from the first face, and wherein the plurality of saw tooth members is arranged lengthwise along the elongated second face. In various embodiments, the saw tooth member with the greater height is located, among the plurality of saw tooth members, furthest away from the first face.

DETAILED DESCRIPTION

Figure 1A:
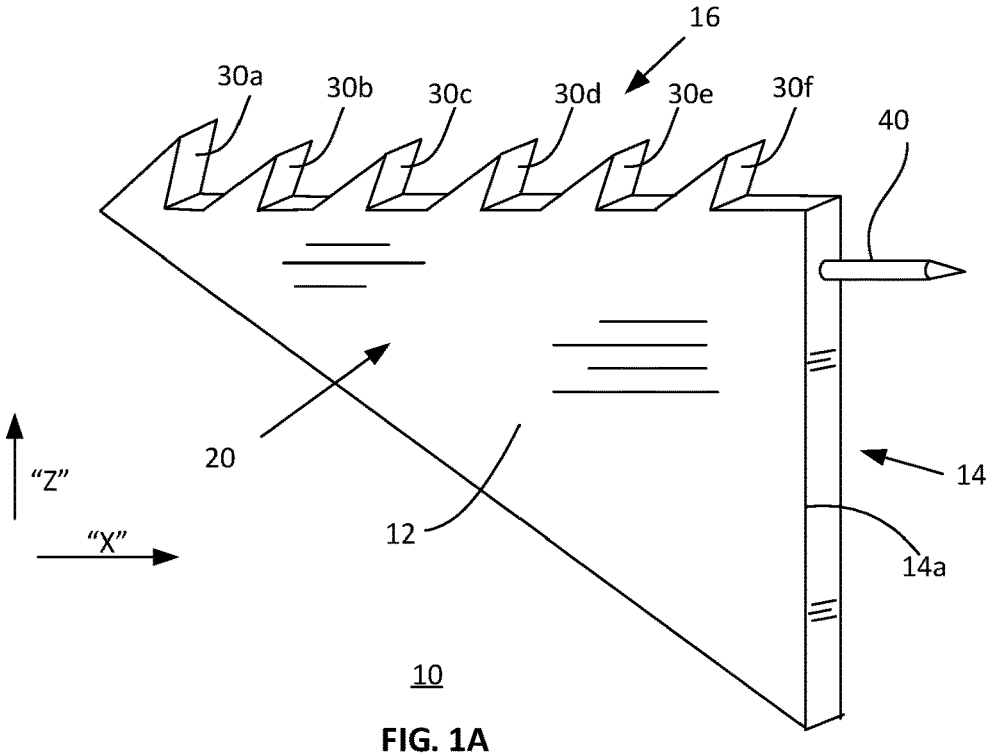
FIG. 1A is a perspective left side view of an embodiment of a hat hanger of the present disclosure.

In the present description, certain specific details are set forth in order to provide a thorough understanding of various embodiments of the disclosure. However, upon reviewing this disclosure one skilled in the art will understand that the various embodiments disclosed herein may be practiced without many of these details. In other instances, some well-known structures and materials of construction have not been described in detail to avoid unnecessarily obscuring the descriptions of the embodiments of the disclosure.

In the present disclosure, to the extent the terms "about," "approximately," and "substantially" are used, they mean±20% of the indicated range, value, or structure, unless otherwise indicated. In the present description, the terms "a" and "an" as used herein refer to "one or more" of the enumerated components. The use of the alternative (e.g., "or") should be understood to mean either one, both, or any combination thereof of the alternatives. As used herein, the terms "include" and "comprise" are used synonymously, the terms and variants of which are intended to be construed as non-limiting. The definitions in this paragraph are intended to apply throughout this disclosure unless otherwise expressly stated.

According to various embodiments of the present disclosure, a hat hanger with a small profile is disclosed that is configured to be mounted to a surface of a vertical wall and for hanging a hat therefrom. In some cases, a user may be able to display and store a hat by hanging the hat on the hat hanger affixed to a wall without fear of the hat being warped or deformed. In various embodiments, the hat hanger, which may also be referred to herein as a wall mounting device, may include a body that is configured to be affixed to a vertical wall. The body having a particular height, length, and thickness and includes at least a first face and a second face. The first face may have a planar surface, and a wall mounting component (e.g., a nail such as a wire brad) that at least partially protrudes from the first surface and that is configured to affix the body to the vertical wall (alternatively an adhesive such as an epoxy may be used to affix the body to the vertical wall), the first face having a width equal to the thickness of the body. The second face may adjoin the first face and that has a plurality of saw tooth members (e.g., serrations), where at least one of the saw tooth members is greater in height than other saw tooth members of the plurality of saw tooth members, the second face being an elongated face having a length that equals the length of the body.

In some embodiments, the hat hanger may include a body that may have a triangular shape and that may be defined by a particular height, length and thickness. For these embodiments, the body may have a first side face and a second side face disposed opposite of the first face and spaced apart from the first side face by the thickness of the body. The body may also include a wall mating face, a top side face, and a bottom face.

The wall mating face may be situated transversely (e.g., crosswise) relative to the first side face and second side face, and may have a length equal to the height of the body, and a width equal to the thickness of the body, with a first edge of the wall mating face being adjoined to the first side face, and with a second edge of the wall mating face being adjoined to the second side face. The top side face may be situated transversely relative to the first side face and second side face, and may be adjoined to the first side face and second side face. The top side face may have a length equal to the length of the body and may have a width equal to the thickness of the body. In various embodiments, the top side face may be serrated by being configured with a plurality of saw tooth members (e.g., serrations). The bottom face may be situated transversely relative to the first side face and the second side face, and may be adjoined to both the wall mating face and the top side face. The bottom face may also be adjoined to the first side face and the second side face. In some alternative embodiments, the body of the hat hanger may not have a triangular shape, but instead, may have other shape types such as a rectangular, pentagonal, and so forth.

Figure 1B:
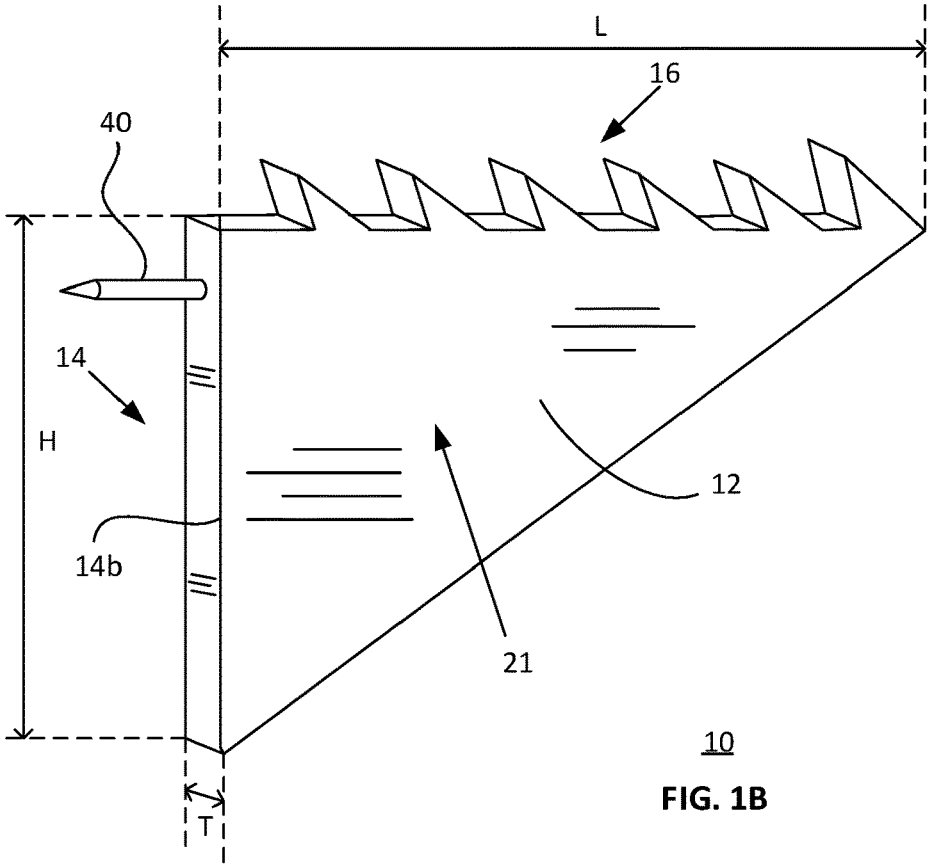
FIG. 1B is a perspective right side view of the hat hanger of FIG. 1A.

Turning to FIGS. 1A and 1B, which are perspective views from opposite sides of a hat hanger 10 according to various embodiments. As illustrated, the hat hanger 10 having a body 12 with a triangular shape and a relatively thin profile. The hat hanger 10 having five faces (e.g., five sides) including a first side face 20, a second side face 21, a wall mating face 14, a top side face 16, and a bottom face 18 (see FIG. 3). The body 12 may be made from a variety of materials including, for example, metal, metal alloy, plastic and/or wood. As illustrated in FIG. 1B, the body 12 has a particular height ("H"), length ("L"), and thickness ("T"). The first side face 20 and the second side face 21 are disposed on opposite sides of the body 12 and spaced apart by the thickness T of the body 12. In some embodiments, the first side face 20 and the second side face 21 may each be planar surfaces. In other alternative embodiments, however, the first side face 20 and the second side face 21 may not be planar surfaces (e.g., concave or convex surfaces, or multi-level surfaces).

Note that in the following description, words such as "front," "forward," "rear," "rearward,", "top," "bottom" and the like, may be used in reference to the hat hanger 10 and to the locations and orientations of various components of the hat hanger 10. Of course, these words may not have any relevance unless there is some point or points of reference. Accordingly, in FIG. 1A, arrow "X" points toward the rear of the hat hanger, while arrow Z points in the upward direction. Thus, the opposite directions to arrows X and Z would be in the forward and downward directions, respectively.

The wall mating face 14 is designed to abut against a vertical wall when the hat hanger 10 is affixed to the surface of the wall. In various embodiments, the wall mating face 14 may comprise of a flat surface and may be situated transversely (e.g., crosswise) relative to the first side face 20 and the second side face 21. In various embodiments, the wall mating face 14 may be an elongated face having a length equal to the height H of the body 12, and a width equal to the thickness T of the body 12. As illustrated in FIGS. 1A and 1B, the wall mating face 14 having a rectangular shape with four sides or edges including a first edge 14*a* that is adjoined to the first side face 20 and a second edge 14*b* that is adjoined to the second side face 21. Note that the word "edge" as used herein may be in reference to a sharp edge, such as the first and second edges 14*a* and 14*b* of FIGS. 1A and 1B, a rounded edge like those illustrated in FIG. 18 (see, for example, 810*a*, 810*b*, and 810*c* of FIG. 18), or may be in reference to any intersection where two or more faces of, for example, the body of a hat hanger merges.

In various embodiments, the wall mating face 14 may include a wall mounting component 40 that at least partially protrudes from the wall mating face 14. In some embodiments, the wall mounting component 40 may be a nail such as a wire brad. In other embodiments, however, other types of wall mounting components may be employed such as a screw or a serrated nail that is not easily removable from a wall once inserted into the wall. In still other embodiments, an adhesive such as an epoxy may be used to affix the hat hanger 10 to a vertical wall. In some embodiments where the wall mounting component 40 is a nail, the nail may not protrude more than ¾ inches (see distance "D" in FIG. 2)

from the wall mating face 14. For example, in one embodiment, the nail protrudes approximately ¼ inch from the wall mating face 14. To affix the hat hanger 10 to, for example, a dry wall, the body 12 with the wall mating face 14 facing the wall surface may be pushed against the wall surface so that the nail penetrates the wall.

Figure 4A:
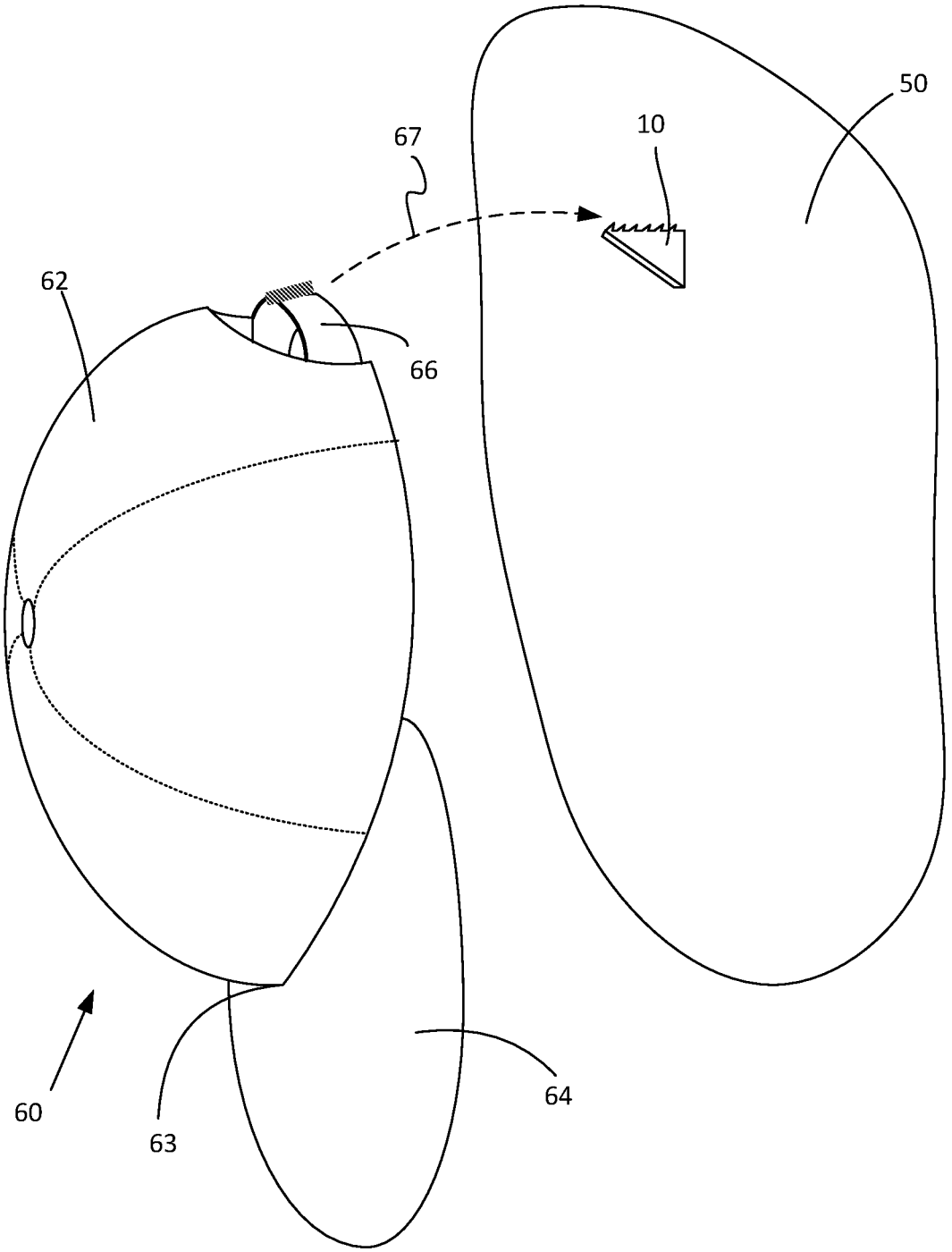
FIG. 4A illustrates an example snapback hat being horizontally positioned over the hat hanger of FIG. 1A.
Figure 4B:
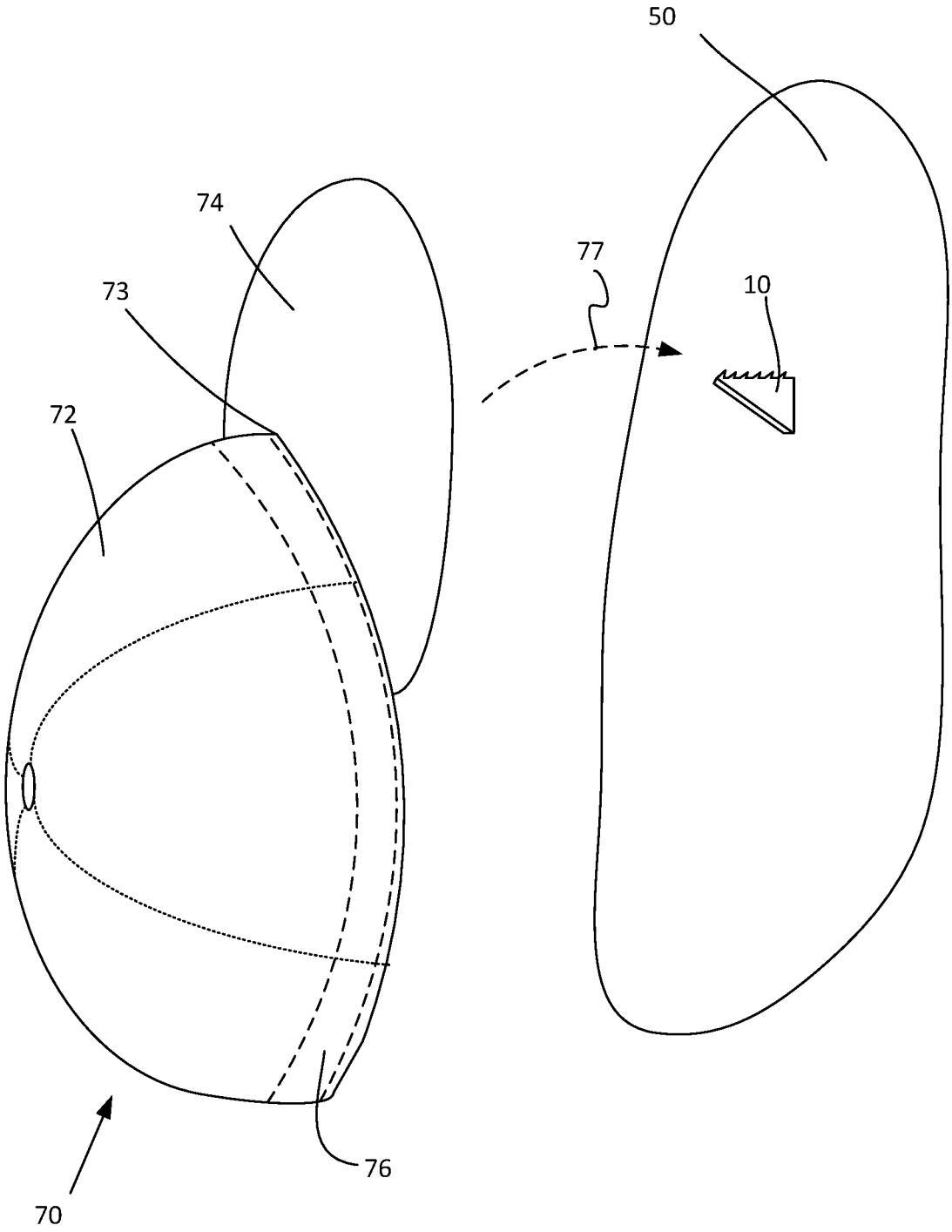
FIG. 4B illustrated an example fitted cap being horizontally positioned over the hat hanger of FIG. 1A.
Figure 5:
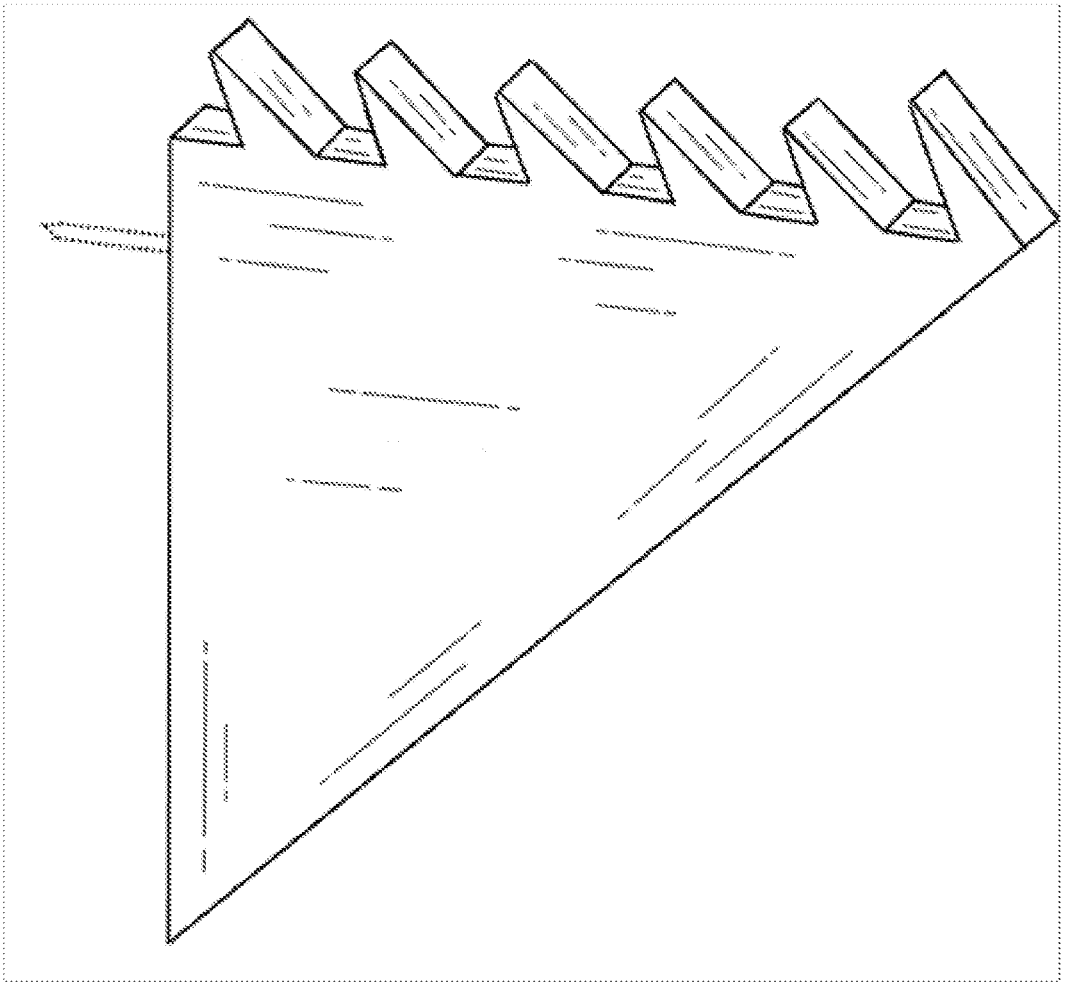
FIG. 5 is a perspective of an embodiment of the hat hanger of the present disclosure.
Figure 6:
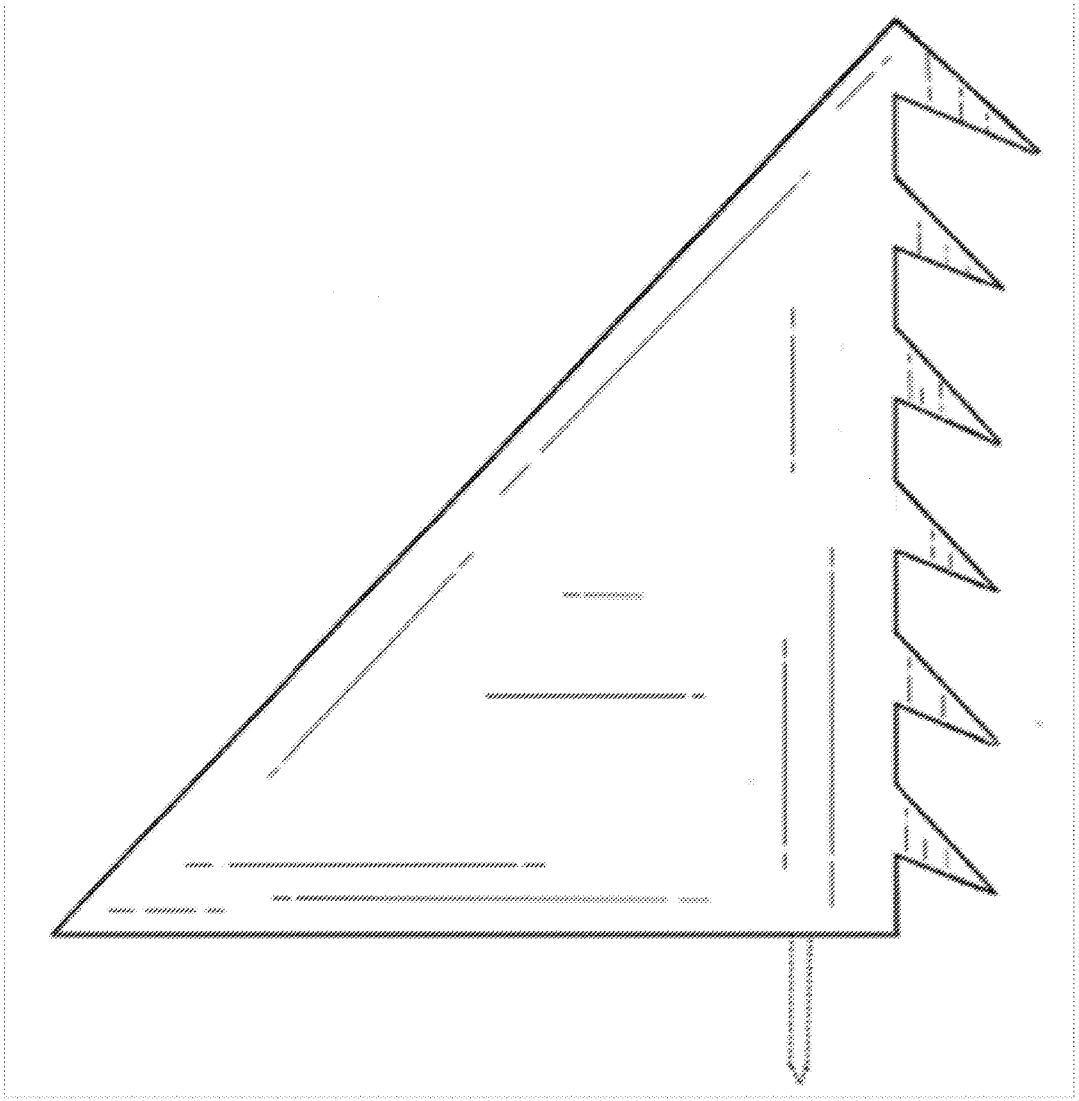
FIG. 6 is a left side elevation view thereof.
Figure 7:
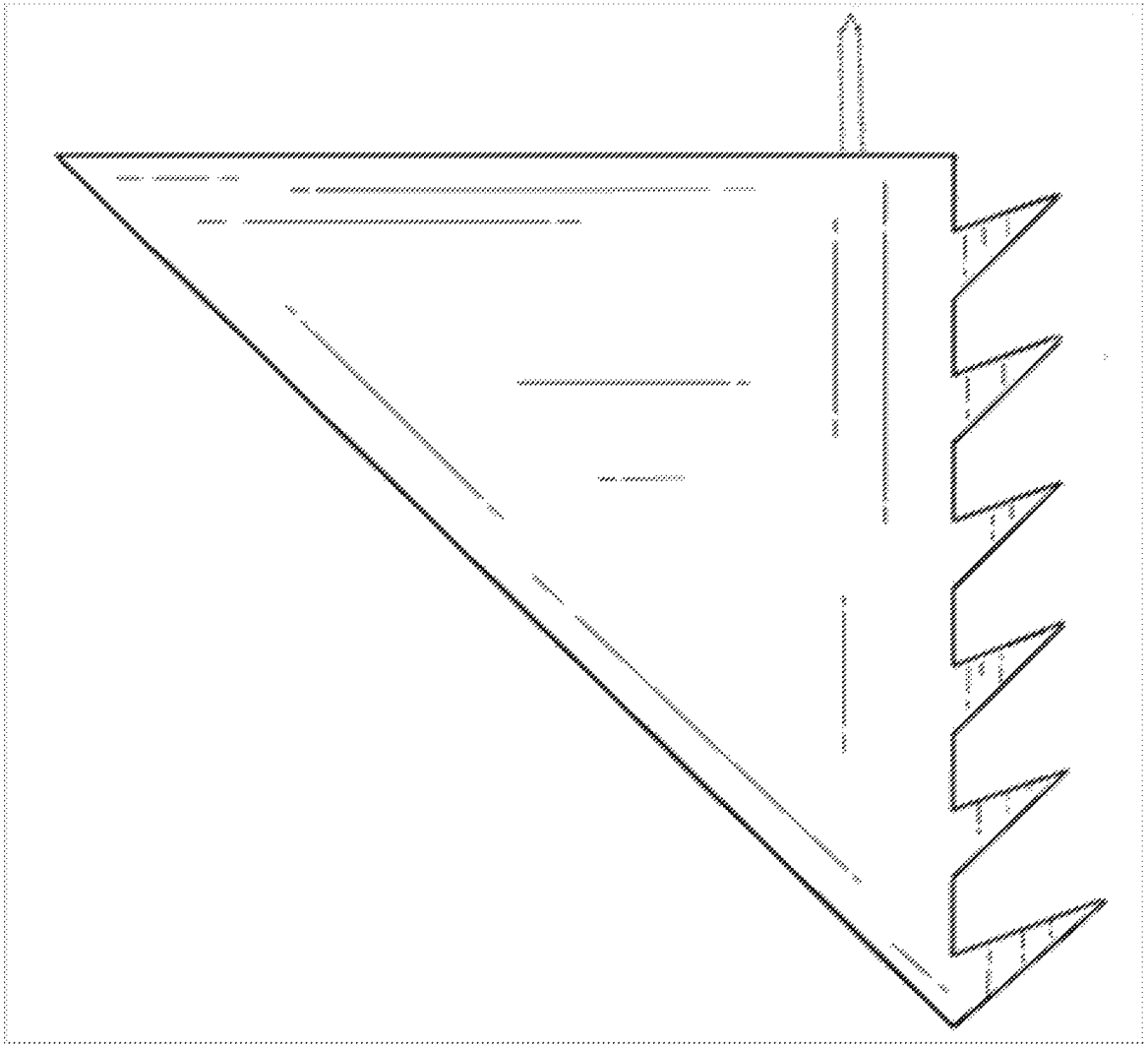
FIG. 7 is a right side elevation view thereof.
Figure 8:
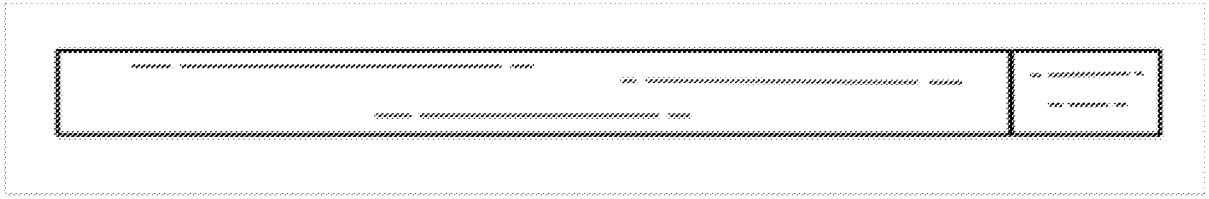
FIG. 8 is a front elevation view thereof.
Figure 9:
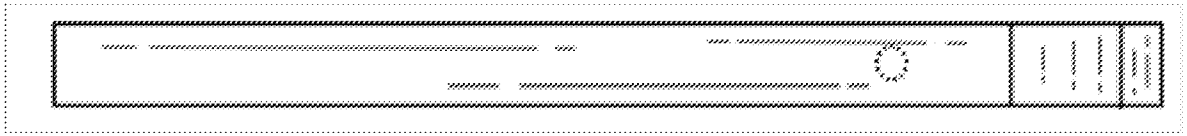
FIG. 9 is a rear elevation view thereof.
Figure 10:
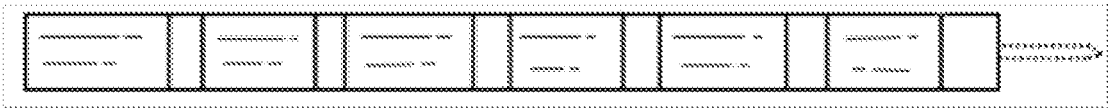
FIG. 10 is a top plan view thereof.
Figure 11:
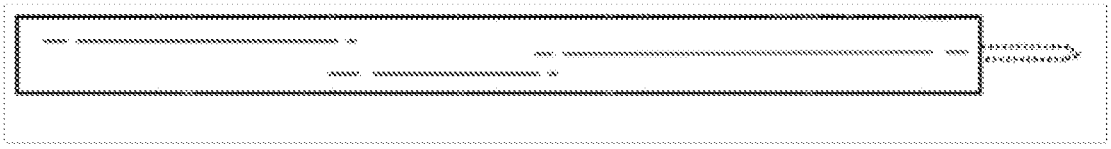
FIG. 11 is a bottom plan view thereof.

In various embodiments, the top side face 16 may be a serrated face that is configured to snag or hook, for example, the inside lining or a strap of a hat as will be further described herein with reference to FIGS. 4A and 4B. As illustrated in FIGS. 1A and 1B, the top side face 16 is situated transversely relative to the first side face 20 and second side face 21. In the illustrated embodiment, the top side face 16 is adjoined to the first side face 20 and the second side face 21 and has a length equal to the length L of the body 12. In some embodiments, the top side face 16 may have an elongated shape having a length L of at least 1.5 inches. For example, in one embodiment, the length L is approximately two inches. In some embodiments, the length of the hat hanger 10 may depend on the type and size of the hat to be hung from the hat hanger 10. The top side face 16 may have a width equal to the thickness T of the body 12. In some embodiments, thickness T may be less than ⅖ inch. For example, in one embodiment, thickness T is approximately ¼ inch.

With respect to height H, the height H should be of sufficient length such that the hat hanger 10 cannot be easily pulled out of a wall that it is affixed to. That is, when the hat hanger 10 is affixed to a wall, the wall mounting component 40 (e.g., a nail) acts as an anchor or a hinge. Thus, the length of the wall mating face 14 acts as a leverage to prevent the hat hanger 10 from being pulled away from the wall when downward pressure is applied to the hat hanger 10. To avoid such a situation, the height H should be of sufficient length to provide sufficient leverage for preventing downward pressures from causing the hat hanger 10 from being pulled out of the wall. For example, in one embodiment, height H is approximately 1¾ inches long.

The serrated top side face 16 may include a plurality of saw tooth members 30*a*, 30*b*, 30*c*, 30*d*, 30*e*, and 30*f*. In various embodiments, the plurality of saw tooth members 30*a*-30*f* may be arranged lengthwise (i.e., longitudinally) along the elongated top side face 16 from one edge 16*a* to an opposite edge 16*b* (see FIG. 2). In various embodiments, saw tooth member 30*a* has a height greater than the other saw tooth members 30*b*-30*f*. For example, and referring to FIG. 2 which is an elevation view of the hat hanger 10, the saw tooth member 30*a* may have a height "A," while saw tooth members 30*b*-30*f* may have a height B that is shorter than height A of the saw tooth member 30*a*. In some embodiments, height A may be at least 20 percent greater than height B. In various embodiments, the top side face 16 is substantially perpendicular to the wall mating face 14. In alternative embodiments, however, the top side face 16 may not be perpendicular to the wall mating face 14.

Figure 2:
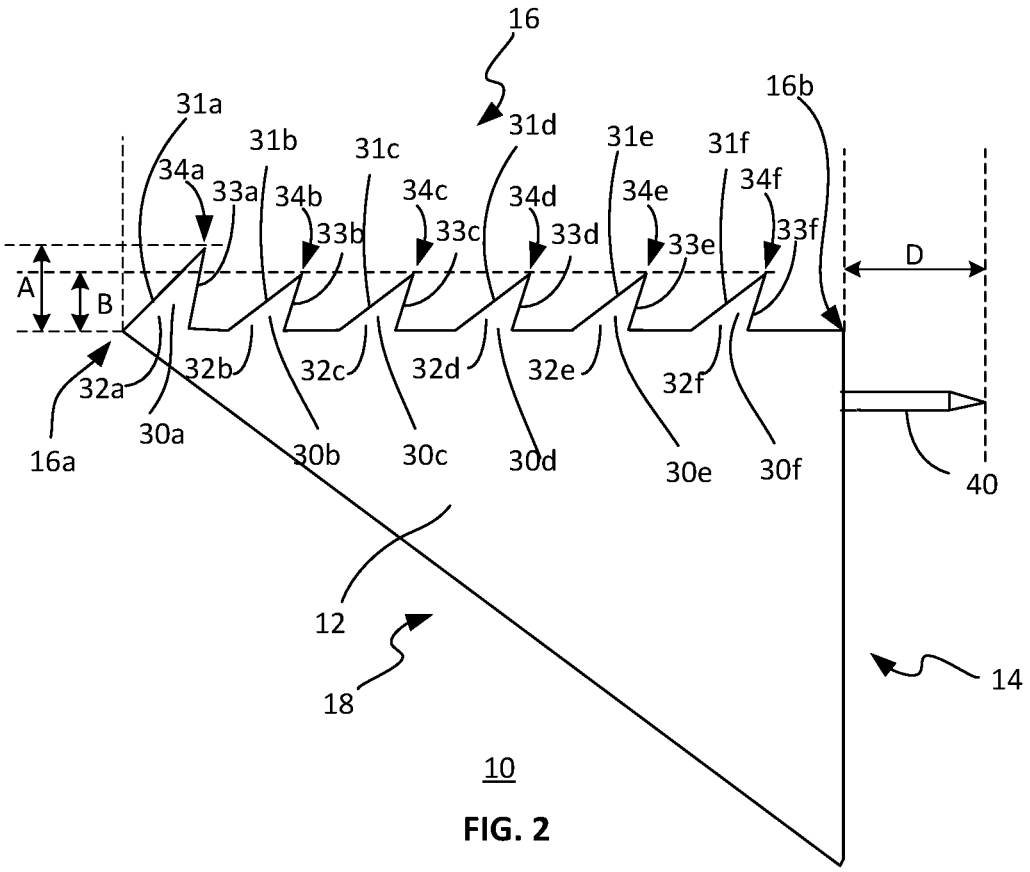
FIG. 2 is a left elevation view of the hat hanger of FIG. 1A.

As illustrated in FIG. 2, saw tooth member 30*a* (e.g., tallest saw tooth member) may be located nearest to edge 16*a* of the top side face 16 among the plurality of saw tooth members 30*a*-30*f* (note that for purposes of this description, saw tooth members 30*a*-30*f* may also be referred to as serrations 30*a*-30*f*). In this case, the saw tooth member 30*a* is disposed at or adjacent to the edge 16*a*. In various embodiments, each of the saw tooth members 30*a*-30*f* includes a rearward edge face 31*a*, 31*b*, 31*c*, 31*d*, 31*e*, and 31*f*, where each of the rearward edge faces 31*a*, 31*b*, 31*c*, 31*d*, 31*e*, and 31*f* is slanted in an upwardly rearward direction and that may be flat. Although not illustrated, in some alternative embodiments, one or more additional saw tooth members may be disposed between edge 16*a* and saw tooth member 30*a*. Each of the saw tooth members 30*a*-30*f* includes a base portion 32*a*, 32*b*, 32*c*, 332*d*, 32*e*, and 32*f* that is connected to the top side face 16. Each of the saw tooth members 30*a*-30*f* further includes an interior face 33*a*, 33*b*, 33*c*, 33*d*, 33*e*, and 33*f* that extends upwards and away from the top side face 16. In some embodiments, each interior face 33*a*-33*f* may be flat and may extend away from the top side face 16 in upward and rearward direction. For example, in some embodiments, each interior face 33*a*-33*f* may be flat and slanted in an upwardly rearward direction. Each of the rearward edge face 31*a*-31*f* of the saw tooth members 30*a*-30*f* extending away from the top side face 16 and adjoins a corresponding opposing face 33*a*-33*f* to form a saw tooth edge 34*a*, 34*b*, 34*c*, 34*d*, 34*e*, and 34*f*.

Figure 3:
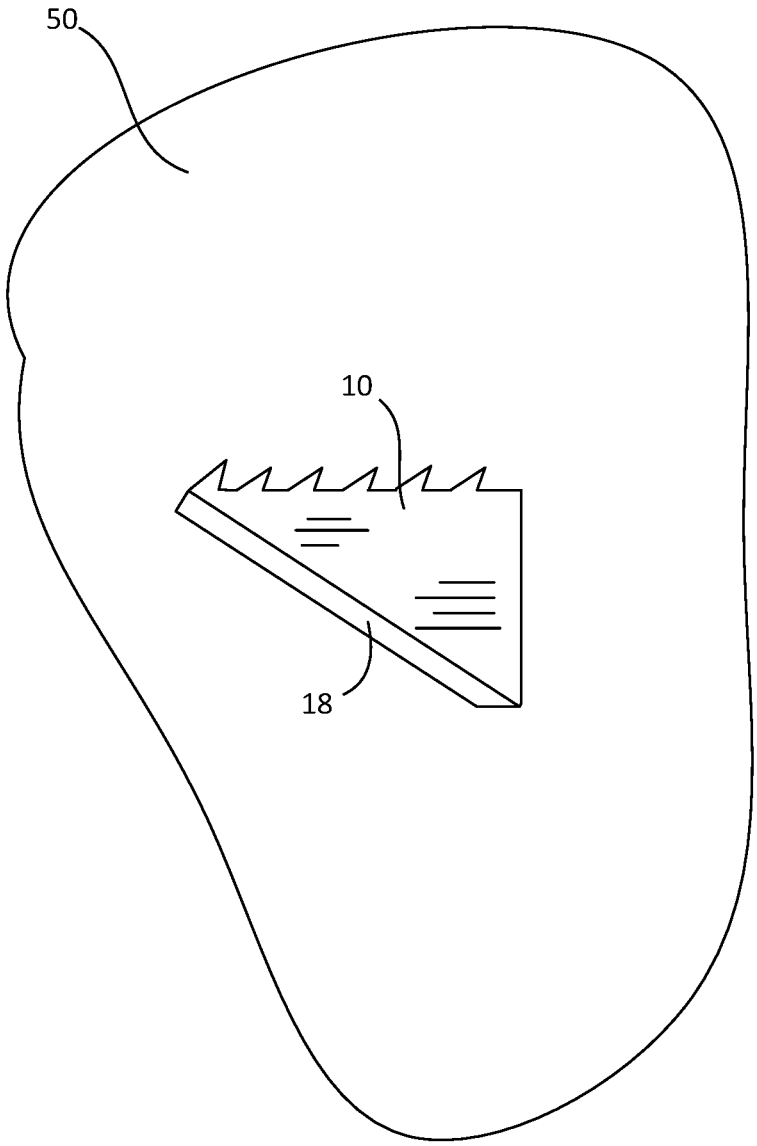
FIG. 3 illustrates the hat hanger of FIG. 1A affixed to a vertical wall.

As illustrated in FIG. 3, which illustrates the hat hanger 10 affixed to a vertical wall 50 (e.g., a drywall), the hat hanger 10 includes a bottom face 18 that is situated transversely (e.g., crosswise) relative to the first side face 20 and second side face 21 of the body 12 and is adjoined to the first side face 20 and the second side face 21. The bottom face 18 may be adjoined to both the wall mating face 14 and the top side face 16, FIG. 4A illustrates a hat 60 being positioned horizontally over a hat hanger 10, which is affixed to a vertical wall 50, in order to hang the hat 60 from the hat hanger 10. The hat 60, which in this case is a particular type of baseball cap commonly called a "snapback hat," includes a crown 62, a visor 64 attached to the front portion 63 of the crown 62, and an adjustable snap closure 66 at the backside of the crown 62. The adjustable snap closure 66 being a strap for tightening or loosening the crown to accommodate different sized heads.

To hang the hat 60 from the hat hanger 10, the interior of the crown 62 may be horizontally positioned over the hat hanger 10 such that when the hat 60 is horizontally moved or repositioned towards the wall 50 the snap closure 66 of the hat 60 will be above the hat hanger 10. Note that in the illustrated example of FIG. 4A, the hat 60 is being raised up from below the hat hanger 10 to position the interior of the crown 62 horizontally over the hat hanger 10 as depicted by broken arrow 67. When the snap closure 66 of the hat 60 is hung on the top side face 16 of the hat hanger 10, the plurality of saw tooth members 30*a*-30*f* may ensure that the snap closure 66 does not slip off the hat hanger 10 by snagging or hooking, for example, the snap closure 66. If the shorter saw tooth members 30*b*-30*f* are unable to hook or snag the snap closure 66, then the taller saw tooth member 30*a* is configured to be able to hook or snag the snap closure 66 to ensure that the hat 60 does not slip off the hat hanger 10. Thus, the taller saw tooth member 30*a* may act as the saw tooth member that has the last chance to snag or hook the snap closure 66 among the plurality of saw tooth members 30*a*030*f*.

Note that in FIG. 4A, the hat 60 is particularly positioned relative to the hat hanger 10 such that when hat 60 is hung from the hat hanger 10 the visor 64 will be hanging below the hat hanger 10. In some cases, however, it may be preferable to position the visor 64 above the hat hanger 10 when the hat 60 is being hung from the hat hanger 10 as illustrated in FIG. 4B. This is because when the hat 60 is hung from the hat hanger 10 and the visor 64 is positioned below the hat hanger 10, the weight of the visor 645 tends to pull the crown 62 down potentially causing the crown 62 to warp. By positioning the visor 64 above the hat hanger 10, the hat hanger 10 can support the weight of the visor 64 preventing the crown 62 from deforming.

FIG. 4B illustrates a hat 70 being positioned horizontally over a hat hanger 10 that is affixed to a vertical wall 50 in order to hang the hat 70 from the hat hanger 10. The hat 70, which is a particular type of baseball cap commonly called a "fitted cap," includes a crown 72, and a visor 74 attached to the front portion 73 of the crown 72. Many types of hats, including hat 70, have an inside lining 76 (FIG. 4B shows the outline of the inside lining 76) that completely or partially encircles the interior of the crown 72. In some cases, the inside lining 76 may be a sweatband.

To hang the hat 70 from the hat hanger 10, the interior of the crown 72 may be horizontally positioned over the hat hanger 10 such that when the hat 70 is horizontally moved or repositioned towards the wall 50, the visor 74 will end up being above or on top of the hat hanger 10 as illustrated by broken arrow 77. When the hat 70 is moved towards the vertical wall 50 to hang the hat 70 from the hat hanger 74, the interior of the crown 72 may cover the hat hanger 10 in such a way that the visor 74 will be positioned above the hat hanger 74. Once the hat 70 is hung from the hat hanger 74, the visor 74 may rest on top of the hat hanger 74. As a result, the weight of the visor 74 will be substantially supported by the hat hanger 74, preventing the crown 72 from deforming. When the hat 70 is hung from the hat hanger 10, the plurality of saw tooth members 30*a*-30*f* may ensure that the hat 70 does not slip off the hat hanger 10 by snagging or hooking, for example, the inside lining 76. That is, when the hat 70 is properly hung from the hat hanger 10, the saw tooth members 30*a*-30*f* are configured such that at least one of the saw tooth members 30*a*-30*f* will snag or hook the inside ling 76 when the hat 70 is horizontally or downwardly begins being pulled or falling (e.g., moving) away from the hat hanger 10. If the shorter saw tooth members 30*b*-30*f* are unable to hook or snag the inside lining 76, then the taller saw tooth member 30*a* is configured to be able to hook or snag the inside lining 76 to ensure that the hat 60 does not slip off the hat hanger 10.

Figure 12A:
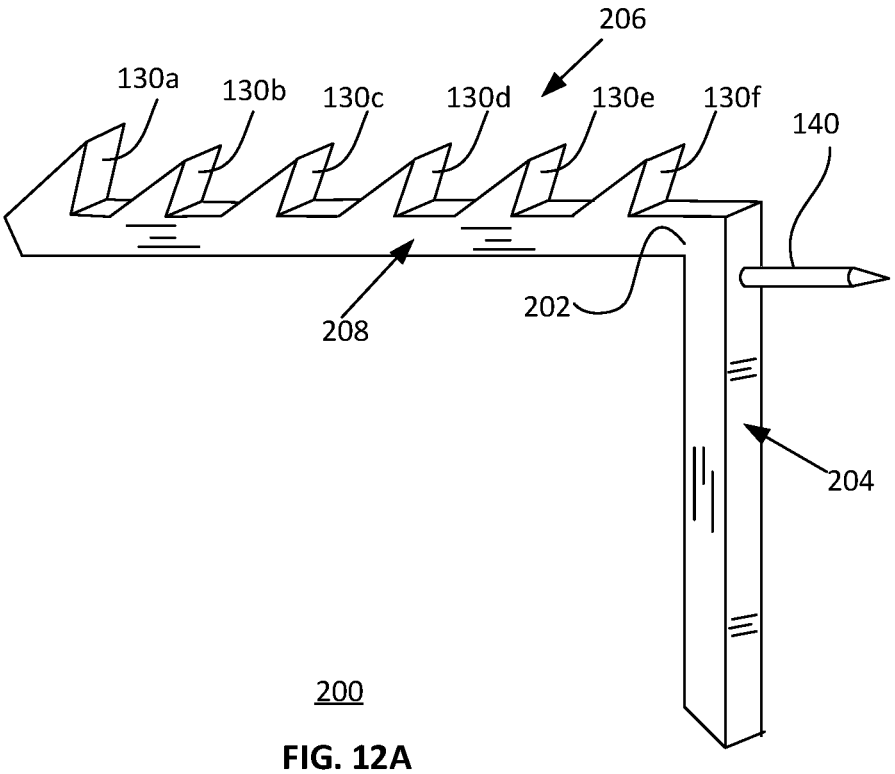
FIG. 12A is a front perspective view of another hat hanger according to another embodiment.

Although the above described hat hanger with the serrated face (including the plurality of saw tooth members) was generally described and illustrated as having a triangular body, in alternative embodiments, the above described serrated face with the plurality of serrations (e.g., saw tooth members) may be employed with other types of hat hanger structures. FIGS. 12A, !2B, 13, 14, 15, 16, 17, and 18 illustrate a variety of hat hanger structures that may include the serrated top face described above in accordance with various embodiments.

Figure 12B:
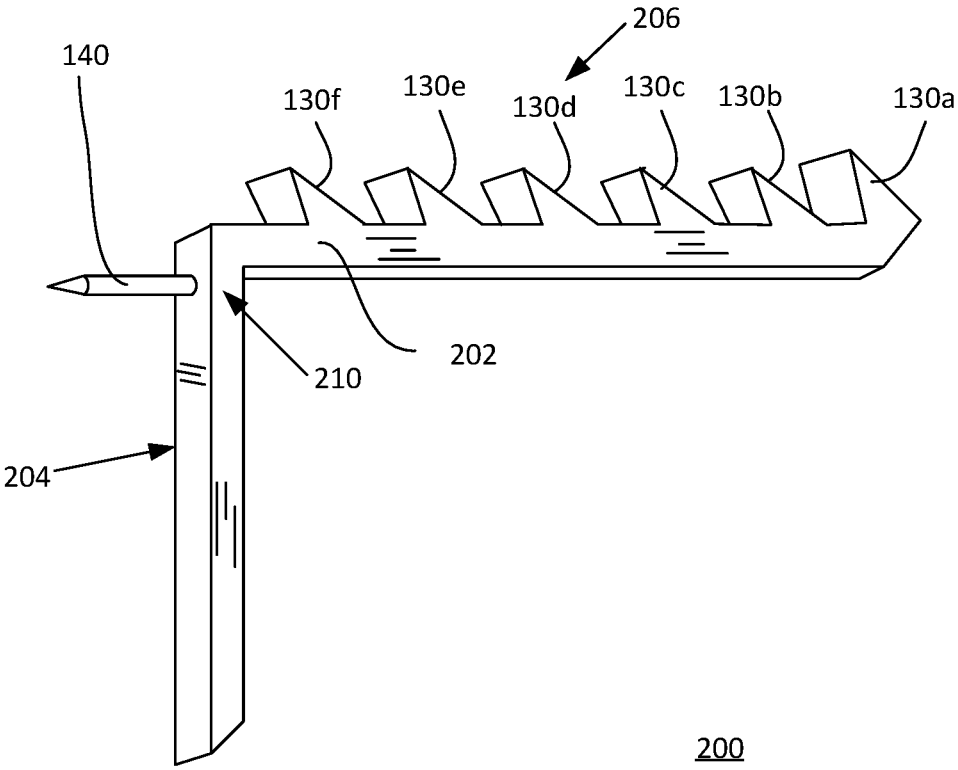
FIG. 12B is a rear perspective view of the hat hanger illustrated in FIG. 12A.

Turning now to FIGS. 12A and 12*b*, which illustrates a hat hanger 200, according to an embodiment of the present disclosure, with a body 202 that has a shape somewhat like the triangular shaped body 12 of the hat hanger 10 previously described except that the mid-portion of the hat hanger body 202 is absent. As with the hat hanger 10 of FIGS. 1A and 1B, the hat hanger 200 of FIGS. 121A and 12B includes a first face 204 with a wall mounting component 140 that is configured for affixing the hat hanger 200 to a vertical wall (including wall mounting component 140), and a second face 206 that is serrated with a plurality of saw tooth members 130*a*, 120*b*, 130*c*, 130*d*, 130*e*, and 130*f*, including a saw tooth member 130*a* that has a height that is greater than the height of the other saw tooth members 130*b*-130*f*. The hat hanger 200 includes side faces 208 and 210 that are adjoined to the first face 204 and the second face 206.

Figure 13:
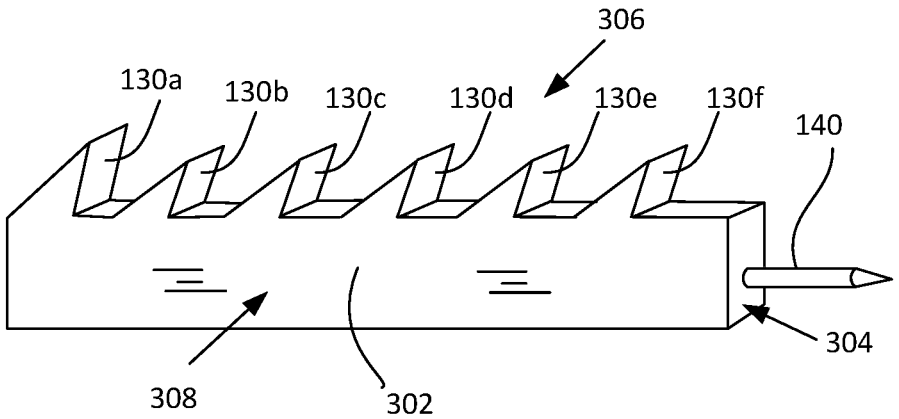
FIG. 13 is a perspective view of another hat hanger according to another embodiment.

FIG. 13 illustrates a hat hanger 300 with a body 302 having a rectangular cuboid shape according to an embodiment of the present disclosure. The hat hanger 300 includes a relatively small first face 304 with a wall mounting component 140 for affixing the hat hanger 300 to a vertical wall, and a second face 306 that is serrated with the plurality of saw tooth members 130*a*-130*f* including the saw tooth member 130*a* that has a height that is greater than the height of the other saw tooth members 130*b*-130*f*. Adjoining the first face 304 and the second face 306 are a pair of opposing side faces, one of which, side face 308, is shown in FIG. 13.

Figure 14:
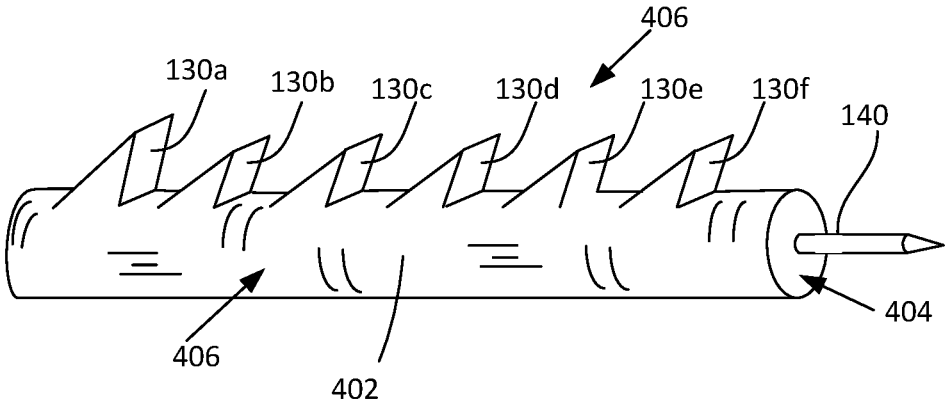
FIG. 14 is a perspective view of another hat hanger according to another embodiment.

FIG. 14 illustrates another hat hanger 400, according to an embodiment of the present disclosure, with a body 402 having a cylindrical shape. As with the hat hanger 300 of FIG. 13, hat hanger 400 includes a relatively small first face 404 with a wall mounting component 140 for affixing the hat hanger 400 to a vertical wall, and a top portion of a second face 406 that is serrated with the plurality of saw tooth members 130*a*-130*f* including the saw tooth member 130*a* that has a height that is greater than the height of the other saw tooth members 130*b*-130*f*. Note that in this case, the second face 406 encircles the cylindrical shaped body 402 of the hat hanger 300. However, the plurality of saw tooth members 130*a*-130*f* is disposed only along a "top" portion of the encircling second face 406.

Figure 15:
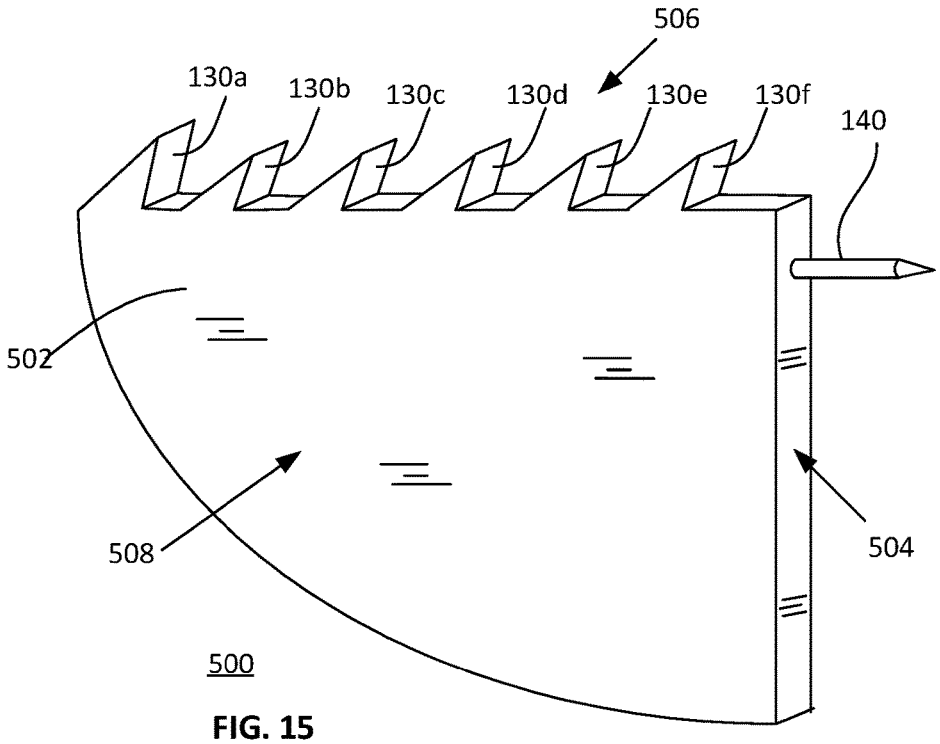
FIG. 15 is a perspective view of another hat hanger according to another embodiment.

FIG. 15 illustrates another hat hanger 500, according to an embodiment of the present disclosure, with a body 502 having a shape that resembles a quarter portion of a coin. The hat hanger 500 includes a first face 504 with a wall mounting component 140 for affixing the hat hanger 500 to a vertical wall, and a second face 506 that is serrated with the plurality of saw tooth members 130*a*-130*f* including the saw tooth member 130*a* that has a height that is greater than the height of the other saw tooth members 130*b*-130*f*. The first face 504 and the second face 506 are adjoined to two opposing side faces, one of which, side face 508, is shown in FIG. 15. In some embodiments, the two side faces (e.g., side face 508) may be planar surfaces or substantially planar surfaces.

Figure 16:
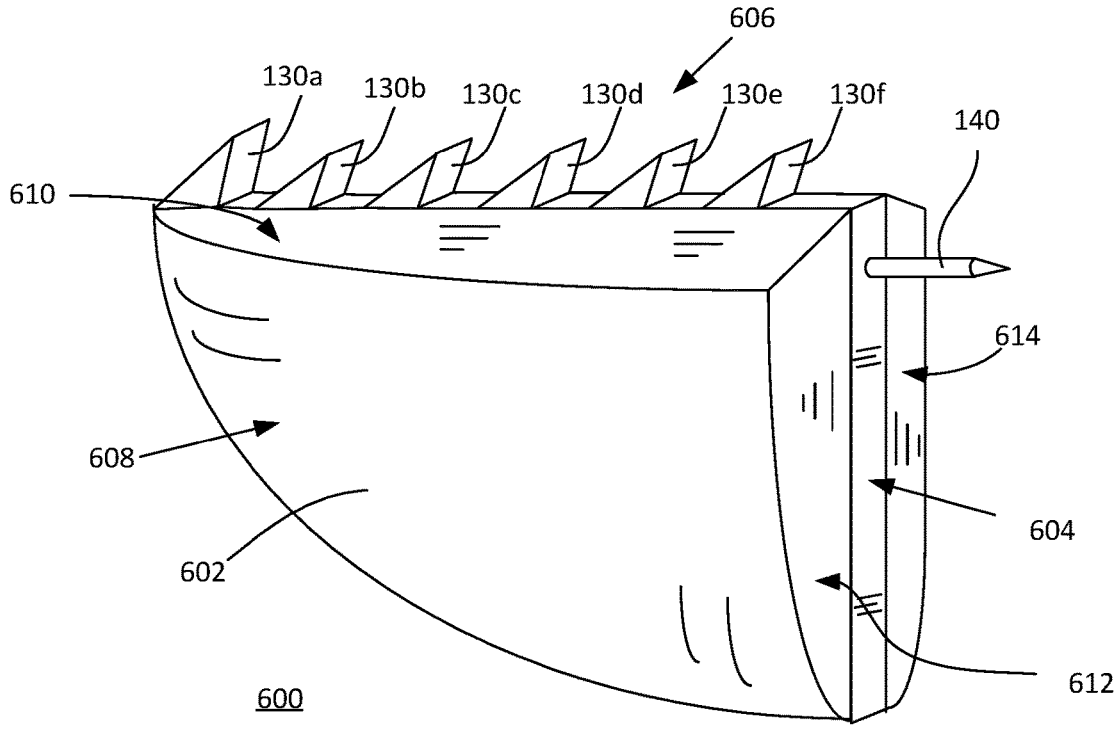
FIG. 16 is a perspective view of another hat hanger according to another embodiment.

FIG. 16 illustrates another hat hanger 600, according to an embodiment of the present disclosure, with a body 602 having a shape that resembles a quarter portion of a sphere. The hat hanger 600 includes a first face 604 with a wall mounting component 140 for affixing the hat hanger 600 to a vertical wall, and a second face 606 that is serrated with the plurality of saw tooth members 130*a*-130*f* including the saw tooth member 130*a* that has a height that is greater than the height of the other saw tooth members 130*b*-130*f*. On both sides of the body 602 are two curved opposing side surfaces, one of which, side face 608, is visible in FIG. 16. Note that unlike the side faces of hat hanger 500 of FIG. 15, the curved side surfaces (e.g., side surface 608) are adjoined to the first face 604 and second face 606 via tapered (or angled) side surfaces. For example, side surface 608 is adjoined to the first face 604 and the second face 606 via tapered surfaces 610 and 612.

Figure 17:
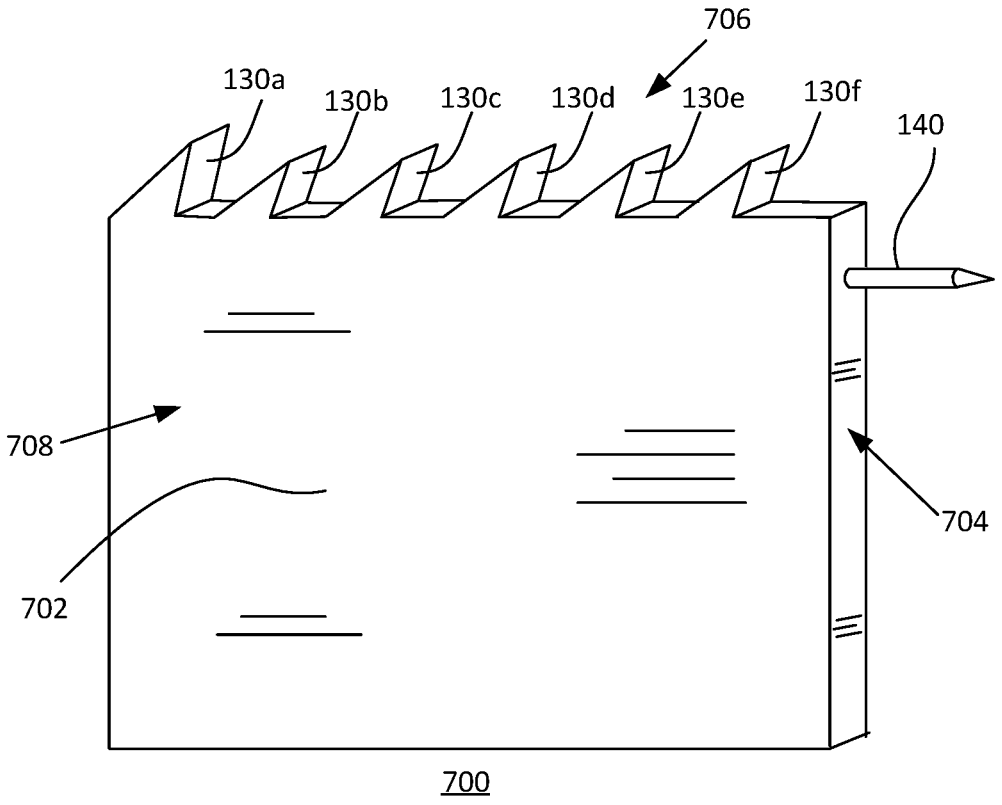
FIG. 17 is a perspective view of another hat hanger according to another embodiment.

FIG. 17 illustrates another hat hanger 700, according to an embodiment of the present disclosure, with a body 702 having a thin cuboid shape. The hat hanger 700 includes a first face 704 with a wall mounting component 140 for affixing the hat hanger 700 to a vertical wall, and a second face 706 that is serrated with the plurality of saw tooth members 130*a*-130*f* including the saw tooth member 130*a* that has a height that is greater than the height of the other saw tooth members 130*b*-130*f*. The first face 704 and the second face 706 are adjoined to two opposing side faces, one of which, side face 708, is shown in FIG. 17. In some embodiments, the two side faces (e.g., side face 708) may be planar surfaces or substantially planar surfaces.

Figure 18:
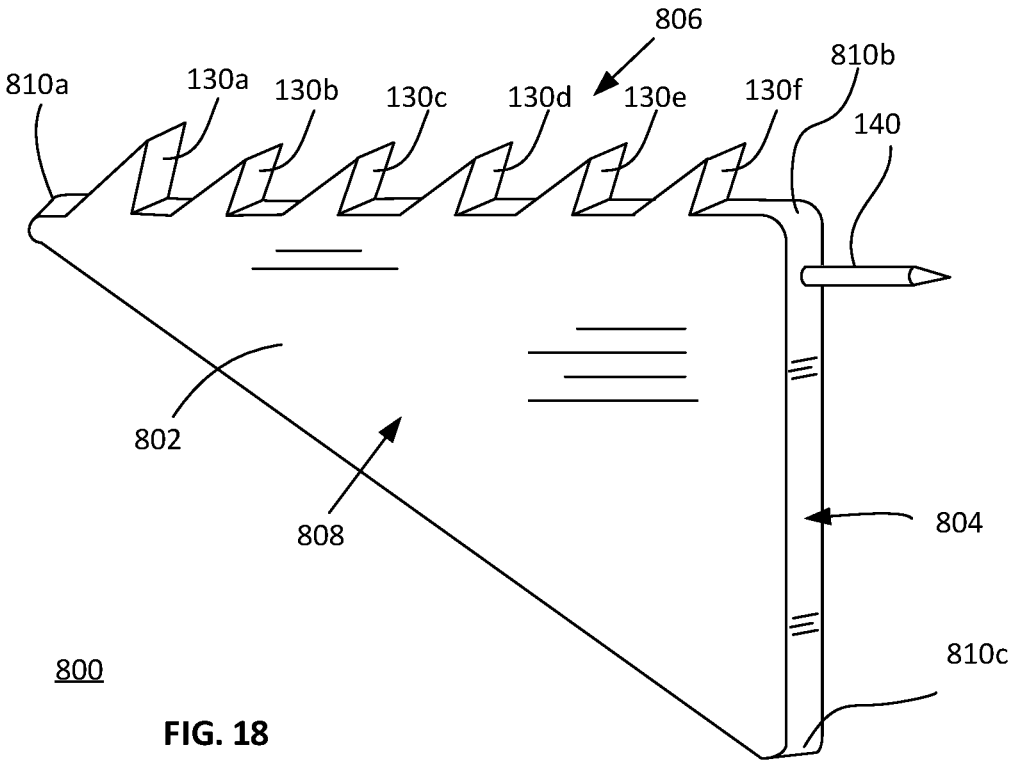
FIG. 18 is a perspective view of another hat hanger according to another embodiment.

FIG. 18 illustrates another hat hanger 800, according to an embodiment of the present disclosure, with a body 802 having a triangular shape similar to the hat hanger 10 of FIGS. 1A and !B except that the corners or edges 810*a*, 810*b*, and 810*c* of the body 802 are rounded edges rather than the sharp edges illustrated in FIGS. 1A and 1B for example. As before, the hat hanger 800 includes a first face 804 with a wall mounting component 140 for affixing to a vertical wall, and a second face 806 that is serrated with the plurality of saw tooth members 130*a*-130*f* including the saw tooth member 130*a* that has a height that is greater than the height of the other saw tooth members 130*b*-130*f*. The first face 804 and the second face 806 are adjoined to two opposing side faces, one of which, side face 808, is shown in FIG. 18. In some embodiments, the two side faces (e.g., side face 808) may be planar surfaces or substantially planar surfaces.

Note that in some alternative embodiments, the wall mounting component 140 (e.g., a nail) illustrated in FIGS. 12A-18 may be replaced with other means of affixing the body of the hat hanger to a vertical wall such as an adhesive (e.g., epoxy). Other structural variations may also be possible in various alternative embodiments without departing from the scope of the disclosure. For example, in some embodiments, one or more additional saw tooth members may be added to a serrated face (e.g., the top side face 16 of FIGS. 1A and 1B) of the disclosed hat hanger structures between the "tallest" saw tooth member (saw tooth member 30*a* of FIG. 1A) and the far edge (e.g., edge 16*a* of FIG. 3) of the serrated face.

Figure 19:
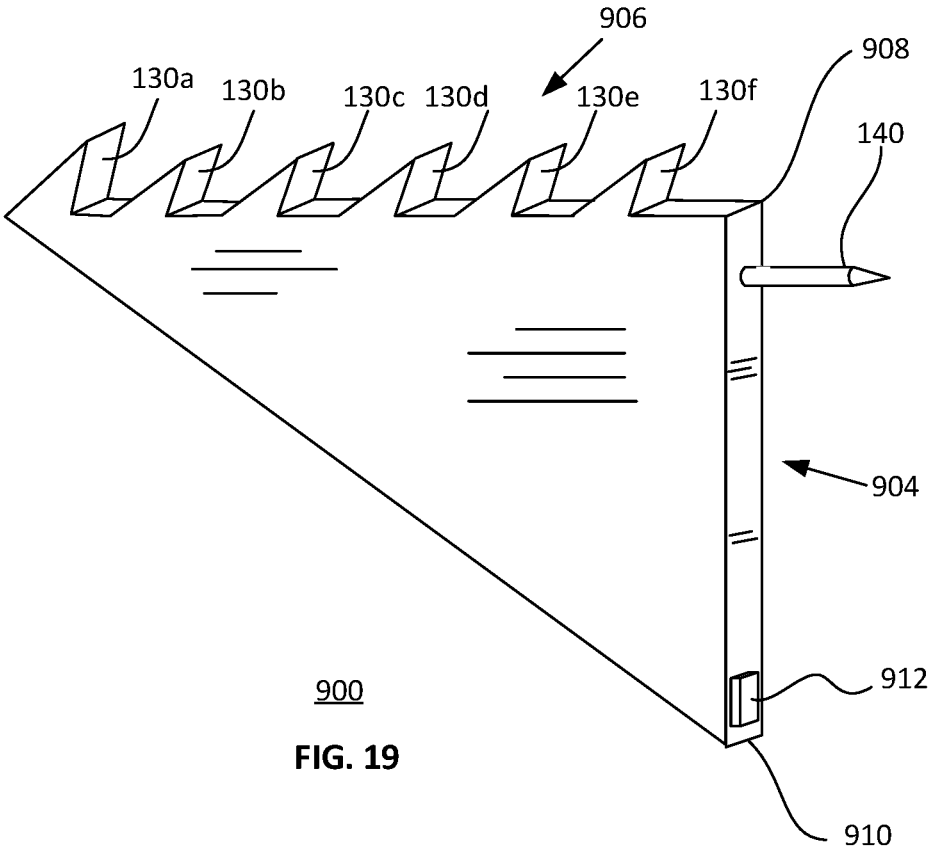
FIG. 19 is a perspective view of another hat hanger according to another embodiment.

FIG. 19 illustrates another hat hanger 900, according to an embodiment of the present disclosure, that mirrors the hat hanger 10 of FIGS. 1A and !B except that the bottom portion of the first face 904 includes an adhesive pad 912. The adhesive pad 912, which in some embodiments, may comprise of polyurethane gel, may prevent the hat hanger 900 from spinning or twisting around the wall mounting component 140 when the hat hanger 900 is affixed to a vertical wall. The hat hanger 900 includes the first face 904 with a wall mounting component 140, which in this case, is a nail, and a second face 906 that is serrated with the plurality of saw tooth members 130*a*-130*f* including the saw tooth member 130*a* that has a height that is greater than the height of the other saw tooth members 130*b*-130*f*. The first face 904 may be an elongated face having a first edge 908 and a second edge 910 opposite of the first edge 908, where the first edge 908 adjoins with the second face 906. The wall mounting component 140 at least partly protruding out of the first face 904 at a location closer to the first edge 908 than to the second edge 910, and whereas the adhesive pad 912 is located closer to the second edge 910 than to the first edge 908.

Note that although the adhesive pad 912 is illustrated in FIG. 19 as occupying a small area of the first face 904 towards the second edge 10, in alternative embodiments, an adhesive pad or other types of adhesive material may be spread along the elongated first face 904. For example, in embodiments where an adhesive is used to affix the hat hanger 900 to a wall rather than a nail, an adhesive may be disposed entirely or substantially entirely on the surface of the first face 904.

The various embodiments described herein, are presented as non-limiting example embodiments of the present disclosure, unless otherwise expressly indicated. After reviewing the present disclosure, an individual of ordinary skill in the art will immediately appreciate that some details and features can be added, removed and/or changed without deviating from the spirit of the disclosure. Reference throughout this specification to "various embodiments," "one embodiment," "an embodiment," "additional embodiment(s)", "alternative embodiments," or "some embodiments," means that a particular feature, structure or characteristic described in connection with the embodiment(s) is included in at least one or some embodiment(s), but not necessarily all embodiments, such that the references do not necessarily refer to the same embodiment (s). Furthermore, the particular features, structures, or characteristics may be combined in any suitable manner in one or more embodiments. These and other changes can be made to the embodiments in light of the above-detailed description. In general, in the following claims, the terms used should not be construed to limit the claims to the specific embodiments disclosed in the specification, but should be construed to include all possible embodiments along with the full scope of equivalents to which such claims are entitled. Accordingly, the claims are not limited by the disclosure.

What is claimed is:

1. A hat hanger comprising:

a body having a height, a length, and a thickness, with a first side face and a second side face disposed opposite of the first side face, wherein the second side face is spaced apart from the first side face by the thickness;

a wall mating face situated transversely relative to the first side face and the second side face, with a first edge of the wall mating face being adjoined to the first side face, and with a second edge of the wall mating face being adjoined to the second side face;

a top side face situated transversely relative to the first side face and second side face, and being adjoined to the first side face and second side face;

a plurality of serrations disposed on the top side face, wherein one of the serrations is greatest in height relative to the other serrations of the plurality of serrations;

wherein the one of the serrations that is greatest in height is disposed furthest, among the plurality of serrations, from an edge of the top side face that adjoins to the wall mating face;

wherein each of the plurality of serrations includes a rearward edge face that extends away from the top side face, the wall mating side being rear face of the hat hanger; and wherein each of the plurality of serrations includes an interior face that extends away from the top side face, and each of the rearward edge face of each of the serrations adjoining a corresponding interior face of each of the serrations to form a saw tooth edge.

2. The hat hanger of claim 1, wherein the one of the serrations that is greatest in height has a height that is 20 percent greater than the other serrations of the plurality of serrations.

3. The hat hanger of claim 1 wherein each of the rearward edge faces is flat and slanted in an upwardly rearward direction.

4. The hat hanger of claim 3, wherein each of the interior faces is flat and slanted in an upwardly rearward direction.

5. The hat hanger of claim 1, wherein the wall mating face further includes a wall mounting component.

6. The hat hanger device of claim 5, wherein the wall mounting component is a nail that protrudes less than ¾ inches away from wall mating face.

7. The hat hanger device of claim 6, wherein the nail is a wire brad.

8. The hat hanger of claim 1, wherein the length of the top side face is at least 1.5 inches.

9. The hat hanger device of claim 1, wherein the thickness of the body is less than ⅖ inch.

10. The hat hanger device of claim 1, wherein the top side face is perpendicular to the wall mating face.

11. A wall mounting device, comprising:

a body;

a first face disposed on the body and having a wall mounting component, configured to affix the body to a vertical wall;

a second face disposed on the body and that adjoins the first face and that has a plurality of saw tooth members, wherein at least one of the saw tooth members is greater in height than other saw tooth members of the plurality of saw tooth members;

wherein the second face is an elongated face with a first edge and a second edge opposite from the first edge, and the plurality of saw tooth members are arranged lengthwise along the elongated second face between the first edge and the second edge, the first edge adjoining the first face;

wherein the saw tooth member with the greater height is located nearest to the second edge among the plurality of saw tooth members;

wherein each of the plurality of saw tooth members includes a rearward edge face that extends away from the second face, the first face being rear face of the wall mounting device; and wherein each of the plurality of saw tooth members includes an interior face that extends away from the second face, and each of the rearward edge face of each of the saw tooth members adjoining a corresponding interior face of each of the saw tooth members to form a saw tooth edge.

12. The wall mounting device of claim 11, wherein the first face is disposed on a rear side of the wall mounting device and the second face is disposed on a top side of the wall mounting device, and wherein each of the rearward edge faces and each of the interior faces is flat and slanted in an upwardly rearward direction.

13. The wall mounting device of claim 11, wherein the first face is an elongated face having a first edge and a second edge opposite the first edge, the first edge adjoining the second face, and wherein the wall mounting component is a nail that at least partially protrudes from the first face and that is located closer to the first edge than the second edge of the first face.

14. The wall mounting device of claim 11, wherein the second face is perpendicular to the first face.

15. The wall mounting device of claim 11, wherein the body having a triangular shape.

16. The wall mounting device of claim 11, wherein the body having a cuboid shape.

17. A wall mounting device, comprising a body;

a first face disposed on the body and having a wall mounting component, configured to affix the body to a vertical wall;

a second face disposed on the body and that adjoins the first face and that has a plurality of saw tooth members, wherein at least one of the saw tooth members is greater in height than other saw tooth members of the plurality of saw tooth members;

wherein the second face is an elongated face with a first edge and a second edge opposite from the first edge, and the plurality of saw tooth members are arranged lengthwise along the elongated second face between the first edge and the second edge, the first edge adjoining the first face;

wherein the saw tooth member with the greater height is located nearest to the second edge among the plurality of saw tooth members; and wherein the first face is an elongated face having a first edge and a second edge opposite the first edge, the first edge adjoining the second face, and wherein the wall mounting component is a nail that at least partially protrudes from the first face and that is located closer to the first edge than the second edge of the first face, and an adhesive pad disposed on the first face and located closer to the second edge than the first edge of the first face.

18. The wall mounting device of claim 17, wherein the adhesive pad comprises polyurethane gel.

19. A wall mounting device, comprising:

a first face disposed on a body and configured to affix the body to a vertical wall;

a second face disposed on the body and adjoined to the first face, the second face having a plurality of saw tooth members, wherein one of the saw tooth members is greater in height than other saw tooth members of the plurality of saw tooth members;

wherein the second face is an elongated face that longitudinally extends away from the first face, and wherein the plurality of saw tooth members is arranged lengthwise along the elongated second face;

wherein the saw tooth member with the greater height is located, among the plurality of saw tooth members, furthest away from the first face;

wherein each of the plurality of saw tooth members includes a rearward edge face that extends away from the second face, the first face being rear face of the wall mounting device; and wherein each of the plurality of saw tooth members includes an interior face that extends away from the second face, and each of the rearward edge face of each of the saw tooth members adjoining a corresponding interior face of each of the saw tooth members to form a saw tooth edge.

* * * * *